US011577245B2

(12) United States Patent
Tachino et al.

(10) Patent No.: US 11,577,245 B2
(45) **Date of Patent: *Feb. 14, 2023**

(54) ELECTROWETTING DEVICE

(71) Applicant: SHARP KABUSHIKI KAISHA, Sakai (JP)

(72) Inventors: Chihiro Tachino, Sakai (JP); Kazuya Tsujino, Sakai (JP); Atsushi Hachiya, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 679 days.

This patent is subject to a terminal disclaimer.

(21) Appl. No.: 16/563,344

(22) Filed: Sep. 6, 2019

(65) Prior Publication Data

US 2020/0078790 A1 Mar. 12, 2020

Related U.S. Application Data

(60) Provisional application No. 62/727,823, filed on Sep. 6, 2018.

(51) Int. Cl.
*B01L 3/00* (2006.01)

(52) U.S. Cl.
CPC . *B01L 3/502792* (2013.01); *B01L 2400/0427* (2013.01)

(58) Field of Classification Search
CPC ..... B01L 3/502792; B01L 2400/0427; B01L 2300/0645; B01L 2300/0887
See application file for complete search history.

(56) References Cited

U.S. PATENT DOCUMENTS

| | | | | |
|---|---|---|---|---|
| 2010/0046084 | A1 | 2/2010 | Kirita et al. | |
| 2010/0053717 | A1 | 3/2010 | Takahashi | |
| 2013/0301108 | A1* | 11/2013 | Lim | G02B 26/005 359/290 |
| 2016/0322504 | A1* | 11/2016 | Yamazaki | G02F 1/136277 |
| 2018/0085756 | A1 | 3/2018 | Kosaka et al. | |
| 2019/0107709 | A1* | 4/2019 | Hara | B01L 3/502707 |
| 2021/0134585 | A1* | 5/2021 | Tsujino | H01L 21/0212 |

FOREIGN PATENT DOCUMENTS

| | | | |
|---|---|---|---|
| CN | 107918206 | A | 4/2018 |
| CN | 107978644 | A | 5/2018 |
| JP | 3045945 | B2 | 5/2000 |
| WO | 2008/084822 | A1 | 7/2008 |
| WO | 2008/099702 | A1 | 8/2008 |
| WO | 2017/078059 | A1 | 5/2017 |

* cited by examiner

*Primary Examiner* — Sahana S Kaup
(74) *Attorney, Agent, or Firm* — ScienBiziP, P.C.

(57) ABSTRACT

An electrowetting device includes a first substrate, a plurality of first electrodes formed on the first substrate, a dielectric layer formed on the plurality of first electrodes, a first water-repellent layer formed on the dielectric layer, a second substrate, a second electrode formed on the second substrate, and a second water-repellent layer formed on the second electrode. The first substrate and the second substrate are arranged with a gap between the first water-repellent layer and the second water-repellent layer. The first electrode includes an indium oxide-zinc oxide layer, the dielectric layer includes a silicon nitride layer, and the silicon nitride layer is formed directly on the indium oxide-zinc oxide layer.

4 Claims, 4 Drawing Sheets

ELECTROWETTING DEVICE

CROSS-REFERENCE TO RELATED APPLICATIONS

This application claims the benefit of priority to U.S. Provisional Application No. 62/727,823 filed on Sep. 6, 2018. The entire contents of the above-identified application are hereby incorporated by reference.

BACKGROUND

Technical Field

The disclosure relates to an electrowetting device.

In recent years, an electrowetting device (also referred to as a micro-fluid device or a liquid droplet device) has been developed. Electrowetting is a phenomenon in which, when an electric field is applied to a liquid droplet that is arranged on a hydrophobic layer provided on an electrode, a contact angle of the squid droplet with respect to the dielectric layer is changed. Through use of electrowetting, for example, a sub-microliter of a fine liquid droplet can be operated. In many cases, electrowetting devices are referred to as Electrowetting On Dielectric Devices (EWODs) in English, and hence, for easy description in the following, are referred to as "EWOD".

In order to achieve an active matrix EWOD (also referred to as "AM-EWOD") configured to drive an EWOD with a thin film electronic circuit (hereinafter, in some cases, referred to as "TFT circuit") including a thin film transistor (hereinafter, referred to as "TFT"), there is an increasing need for the EWOD that can be driven at a low voltage.

SUMMARY

A voltage to be applied to a liquid droplet is dependent on a dielectric constant and a thickness of a dielectric layer present between the liquid droplet and an electrode. That is, in order to increase a voltage to be effectively applied to the liquid droplet, it is desired that the dielectric constant of the dielectric layer be high and the thickness be small.

However, when the thickness of the dielectric layer is reduced, a breakdown voltage of the dielectric layer is lowered, that is, there arises a problem in that a leak failure is caused.

In accordance with the examinations conducted by the inventors of the disclosure, a sufficient breakdown voltage cannot be obtained in some cases when adopting a configuration including a silicon nitride (SiN) layer as a dielectric layer on an electrode formed of ITO (also denoted with indium oxide-tin oxide or $In_2O_3$—$SnO_2$) as described in, for example, WO 2017/078059.

The disclosure has an object to provide an electrowetting device, which includes a dielectric layer excellent in breakdown voltage compared to the related art and can be driven at a low voltage.

According to embodiments of the disclosure, the solution described in the following items is provided.

Item 1

An electrowetting device, including, a first substrate, a plurality of first electrodes formed on the first substrate, a dielectric layer formed on the plurality of first electrodes, a first hydrophobic layer formed on the dielectric layer, a second substrate, a second electrode formed on the second substrate, and a second hydrophobic layer formed on the second electrode. The first substrate and the second substrate are arranged with a gap between the first hydrophobic layer and the second hydrophobic layer, and each of the plurality of first electrodes includes an indium oxide-zinc oxide layer, the dielectric layer includes silicon nitride layer, and the silicon nitride layer is formed directly on the indium oxide-zinc oxide layer.

Item 2

The electrowetting device in Item 1 in which the dielectric layer has a layered structure including two or more silicon nitride layers having different hydrogen concentrations.

Item 3

The electrowetting device Item 2 in which the dielectric layer includes a first silicon nitride layer held in contact with each of the plurality of first electrodes and a second silicon nitride layer formed on side of the first silicon nitride layer, the side close to the first hydrophobic layer, and the second silicon nitride layer has a hydrogen concentration lower than a hydrogen concentration of the first silicon nitride layer.

Item 4

The electrowetting device in Item 3 in which the second silicon nitride layer is held in contact with the first hydrophobic layer.

According to an embodiment of the disclosure, the electrowetting device, which includes the dielectric layer excellent in breakdown voltage compared to the related art and can be driven at a low voltage, is provided.

BRIEF DESCRIPTION OF DRAWINGS

The disclosure will be described with reference to the accompanying drawings, wherein like numbers reference like elements.

Each of FIGS. 3A to 3G is a schematic cross-sectional view illustrating an example of a method of manufacturing the electrowetting device 100.

Each of FIGS. 4A to 4D is a schematic cross-sectional view illustrating an example of a method of manufacturing the electrowetting device 100.

DESCRIPTION OF EMBODIMENTS

Now, with reference to the drawings, descriptions of a configuration of an electrowetting device and a manufacturing method thereof according to embodiments of the disclosure are provided. In the following, an active matrix electrowetting device is exemplified, but the electrowettig device according to an embodiment of the disclosure is not limited to the example.

Figure 1:
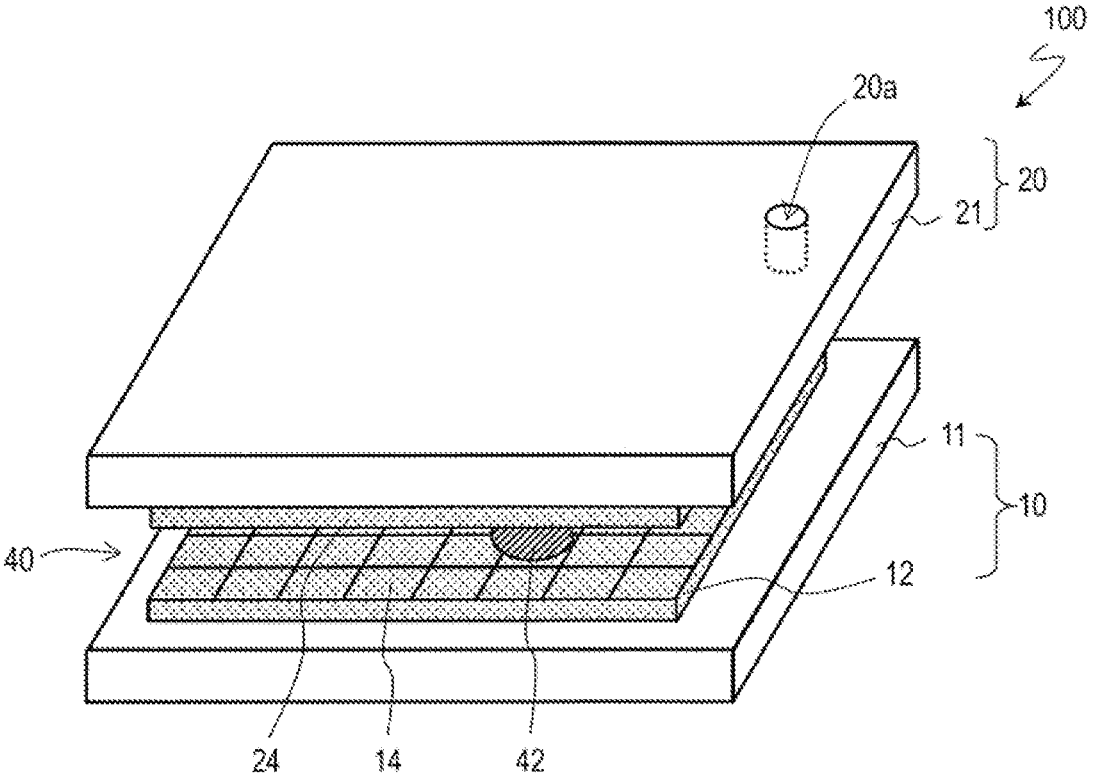
FIG. 1 is a schematic perspective view illustrating an overall configuration of an electrowetting device 100 according to an embodiment of the disclosure.

FIG. 1 is a schematic perspective view illustrating an overall configuration of an active matrix electrowetting device (AM-EWOD) 100 according to an embodiment of the disclosure.

The AM-EWOD 100 includes a TFT substrate 10 and a counter substrate 20. The TFT substrate 10 includes a substrate 11, a plurality of electrodes 14 formed on the substrate 11, a dielectric layer 16 formed on the plurality of electrodes 14, and a hydrophobic layer 18 formed on the dielectric layer 16. The plurality of electrodes 14 are arranged in, for example, an array shape, and are connected to a TFT circuit 12 such that a voltage can be applied independently to each of the plurality of electrodes 14. In the following description, each of the plurality of electrodes 14 is referred to as a unit electrode 14.

The counter substrate 20 includes a substrate 21, an electrode 24 formed on the substrate 21, and a hydrophobic layer 28 formed on the electrode 24. The TFT substrate 10 and the counter substrate 20 are arranged to form a gap (flow path) 40 between the hydrophobic layer 18 and the hydrophobic layer 28. A liquid droplet 42 is injected in the gap 40 through, for example, a through-hole 20*a* provided in the counter substrate 20. A plurality of through-holes 20*a* may be formed, and a plurality of liquid droplets 42 may be present. The electrode 24 is arranged to face the plurality of unit electrodes 14 with each other with intervened by the gap 40, and the electrode 24 is referred to as a counter electrode 24 or a common electrode 24.

The TFT circuit 12 applies a desired voltage to the plurality of unit electrodes 14 and the counter electrode 24 in accordance with a control signal supplied from an external drive circuit (not shown), and moves the liquid droplet 42, for example.

Figure 2:
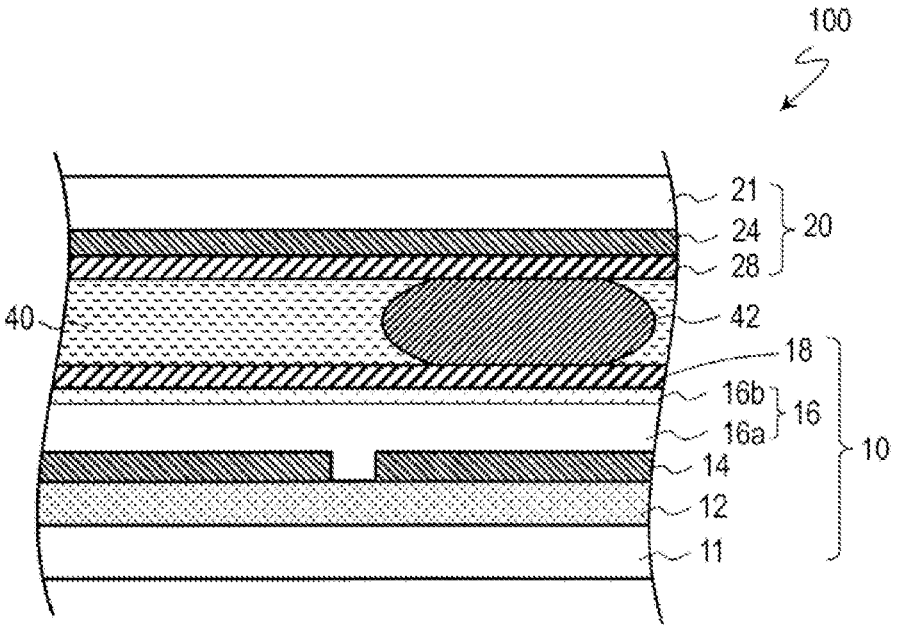
FIG. 2 is a schematic partial cross-sectional view of a cross-sectional configuration of the electrowetting device 100.

Next, with reference to FIG. 2, a detailed description on the configuration of the AM-EWOD 100 will be provided.

On the TFT substrate 10 of the AM-EWOD 100, the unit electrode 14 includes an indium oxide-zinc oxide layer (hereinafter, referred to as "InZnO layer"), the dielectric layer 16 includes a silicon nitride layer (hereinafter, referred to as "SiN layer"). The silicon nitride layer formed directly on the InZnO layer. Note that, a stoichiometric composition of silicon nitride is $Si_3N_4$, and, as widely known, film having a different composition is obtained in accordance with a film formation condition. For example, an Si-rich composition is more likely to be obtained, and a content rate of hydrogen differs. SiN has a relatively high dielectric constant of approximately seven ("relative dielectric constant" in a strict manner; however, for easy description, referred to as "dielectric constant" herein), and a fine film can be obtained. Thus, an SiN layer is suitably used as the dielectric layer 16. For example, in the EWOD described in WO 2017/078059, the SiN layer is used as a dielectric layer.

However, as described later in detail with test examples, when an SiN layer is formed on nit electrode formed of an ITO layer similarly to the EWOD in WO 2017/078059, a defect is formed the SiN layer, and a leak failure is caused. As a result, a sufficient breakdown voltage cannot be obtained in some cases. In accordance with the examinations conducted by the inventors of the disclosure, this is caused by progress in crystallization of the ITO layer due to a thermal history during production of the TFT substrate. That is, it is conceived that, due to change in volume and/or change in surface shape along with the crystallization of the ITO layer, a defect (or a part that becomes a defect by voltage application) is formed in the SiN layer formed directly on the ITO layer.

In contrast, in the EWOD 100 according to the embodiment of the disclosure, the SiN layer is formed directly on the InZnO layer. The InZnO layer is a thermally stable amorphous compared to the ITO layer, and hence crystallization is less liable to progress due to the thermal history during production of the TFT substrate 10. Therefore, formation of a defect in the SiN layer on the InZnO layer is suppressed. The thickness of the InZnO layer is not particularly limited, and is, for example, from 50 nm to 150 nm. When the thickness is smaller than 50 nm, sufficient conductivity cannot be obtained in some cases. When the thickness exceeds 150 nm, conductivity is saturated. Thus, both cases are not preferred in terms of mass productivity. Further, in order to obtain a thermally stable amorphous phase, for example, it is preferred that the InZnO layer be formed at a temperature of 300° C. or lower, more preferably, at a temperature of 250° C. or lower by sputtering.

The dielectric layer 16 may be formed of a single SiN layer, but it is preferred that the dielectric layer 16 have a layered structure including two or more SiN layers with different compositions. It is preferred that the dielectric layer 16 include two or more silicon nitride layers with different hydrogen concentrations. When the dielectric layer 16 includes a first silicon nitride layer held in contact with the InZnO layer of the unit electrode 14 and a second silicon nitride layer formed on a side of the first silicon nitride layer, which is close to the hydrophobic layer 18, it is preferred that the hydrogen concentration of the second silicon nitride layer is lower than the hydrogen concentration of the first silicon nitride layer. The second silicon nitride layer may be held in contact with a first hydrophobic layer.

The entire thickness of the SiN layers that form the dielectric layer 16 is not particularly limited. For example, it is preferred that the entire thickness be from 100 nm to 500 nm. When the entire thickness of the SiN layers is smaller than 100 nm, a sufficient breakdown voltage cannot be obtained in some cases. In view of a breakdown voltage, it is preferred that the entire thickness of the SiN layers exceed 200 nm. Further, when the entire thickness of the SiN layers is increased, a voltage to be effectively applied to a liquid droplet is reduced. Thus, it is preferred that the entire thickness of the SiN layers be 400 nm or smaller.

The SiN layers may be formed by, for example, the plasma CVD. The SiN layers with different hydrogen concentrations may be formed through use of a publicly known method that is freely selected. For example, the SiN layers are obtained by using silane, ammonia, and nitrogen as raw materials and controlling a concentration of ammonia.

Further, as illustrated in FIG. 2, it is preferred that the surface of the dielectric layer 16 formed of the SiN layer (the surface on which the hydrophobic layer 18 is formed) be oxidized. In the SiN layer 16, a part that is not oxidized is indicated with a reference symbol 16*a*, and a part that is oxidized (a part with a high oxygen concentration) is indicated with a reference symbol 16*b*. The parts are referred to as "non-oxidized layer 16*a*" and "oxidized layer 16*b*", respectively. By forming the oxidized part (part with a high oxygen concentration) 16*b* in the SiN layer, an advantage where adhesiveness with the hydrophobic t layer 18 is improved can be obtained. Oxidation of the surface of the SiN layer may be achieved by, for example, annealing in an air or in an oxide atmosphere (at a temperature of, for example, from 100° C. to 250° C.).

The counter electrode 24 of the counter substrate 20 is formed of a transparent oxide conductive layer such as an ITO layer, an InZnO layer, and a ZnO layer. The oxide conductive layer is formed by, for example, sputtering. The thickness of the counter electrode 24 is, for example, from 50 nm to 150 nm.

Each of the hydrophobic layers 18 and 28 is an independent fluorine-based resin layer having a thickness of, for example, from 30 nm to 100 nm. It is preferred that a fluorine-based resin be chemically bonded to the surface of the oxide conductive layer, and, for example, have a terminal functional group. As the terminal functional group, —Si—$(OR)_n$, —NH—$Si(OR)_n$, —CO—NH—$Si(OR)_n$, and —COOH can be exemplified (n is an integer of from 1 to 3). Further, a silane coupling agent or a fluorine-based primer may be used in combination. As a fluorine-based resin, for example, CYTOP (trade name) manufactured by Asahi Glass Co., Ltd., may be used suitably.

Through use of a fluorine-based resin solution (including a fluorine-based resin solvent), the fluorine-based resin layer may be formed by a publicly known application method such as a dipping coating method, a slit coating method, and a spray coating method or a publicly known printing method. In order to improve removal of the solvent and/or stability of the fluorine-based resin, it is preferred that heat treatment of, for example, approximately from 170° C. to 200° C. be performed.

Figure 4A:
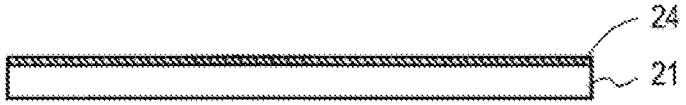
Figure 4B:
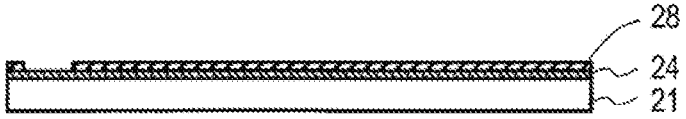
Figure 4C:
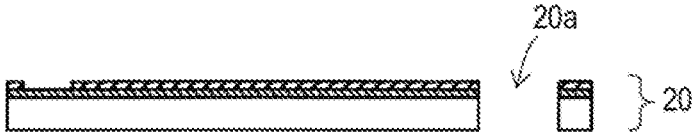
Figure 4D:
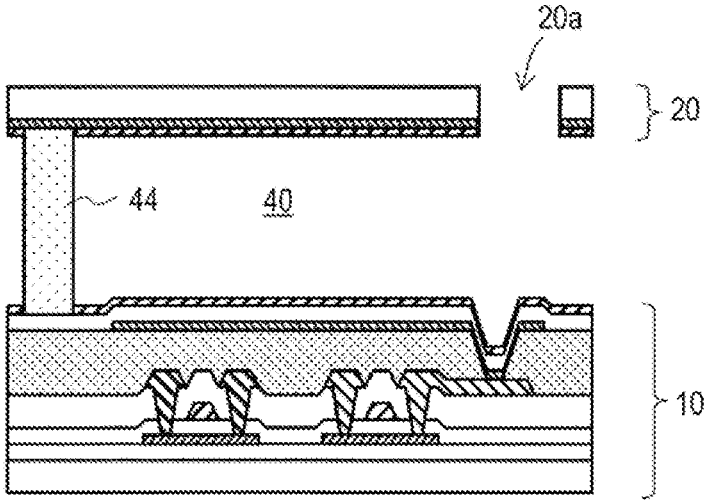

Note that, it is preferred that the hydrophobic layers 18 and 28 be prevented from being formed at portions where a sealing portion configured to bond the TFT substrate 10 and the counter substrate 20 to each other is formed (see FIG. 4D). For example, after a fluorine-based resin film is formed on the entire surface of the substrate, an opening may be formed at a portion being the sea portion by, for example, a photolithography process.

Note that, as the liquid droplet 42, conductive liquid such as ionic liquid and polar is used. As the liquid droplet 42, for example, a water, electrolytic solution (electrolyte water solution), alcohols, and various types of ionic liquid may be used. As examples of such liquid, a whole blood specimen, a bacterial cell suspension, a protein or antibody solution, and various types of buffer solutions are exemplified.

Further, non-conductive d that is not mixed with the liquid droplet 42 may be injected in the gap (flow path) 40. For example, a space in the gap 40 other than the liquid droplet 42 may be filled with the non-conductive liquid.

Next, with reference to FIGS. 3A to 4D, a description of an example of a manufacturing method of the EWOD 100 will be provided. Note that, the TFT circuit 12 is not limited to that exemplified in the following description, and a publicly known TFT circuit may be used.

Each of FIG. 3A to 3G is a cross-sectional view illustrating an example of a manufacturing method of the TFT substrate 10 of the EWOD 100.

Figure 3A:
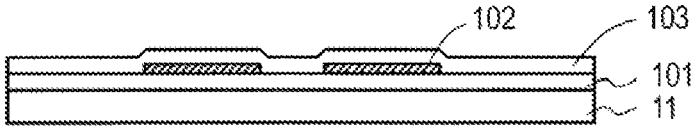

First, as illustrated in FIG. 3A, for example, an optional buffer layer 101 is formed on a glass substrate 11. The buffer layer 101 may be a layered body formed of a single layer or a two or more layers selected from a group including an SiN layer, an $SiO_2$ layer, and an SiON layer. The thickness of the buffer layer 101 is, for example, from 100 nm to 300 nm.

An amorphous silicon film having a film thickness of, for example, approximately from 20 nm to 100 nm is formed on the buffer layer 101. After that, the amorphous silicon film is crystallized, and a polysilicon film is obtained. The polysilicon film is subjected to patterning in a photolithography process. In this manner, a semiconductor layer 102 is obtained.

A gate insulating layer 103 is formed on the semiconductor layer 102. The gate insulating layer 103 is, for example, an SiN layer, an $SiO_2$ layer, or an SiN layer/$SiO_2$ layer (layered structure), and has a thickness of, for example, from 50 nm to 200 nm.

Figure 3B:
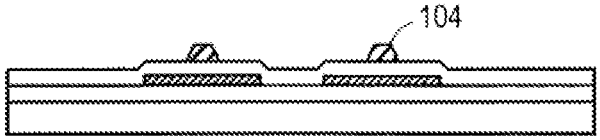

Next, as illustrated in FIG. 3B, a gate electrode 104 is formed on the gate insulating layer 103. The gate electrode 104 is formed by subjecting a metal layer formed of, for example, such as W, Mo, or Al, to patterning in a photolithography process. The thickness of the gate electrode 104 is, for example, from 100 nm to 400 nm. In order to improve adhesiveness and improve contact resistance, a layered structure of W/Ta, MoW, Ti/Al, Ti/Al/Ti, Al/Ti, and the like or an alloy layer may be used.

Figure 3C:
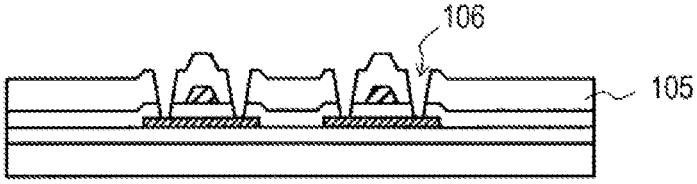

Next, as illustrated in FIG. 3C, an interlayer insulating layer 105 is formed. The interlayer insulating layer 105 may be an SiN layer, an $SiO_2$ layer, an SiON layer, or a layered structure thereof. The thickness of the interlayer insulating layer 105 is, for example, from 500 nm to 900 nm. A contact hole 106 is formed by patterning in a photolithography process.

Figure 3D:
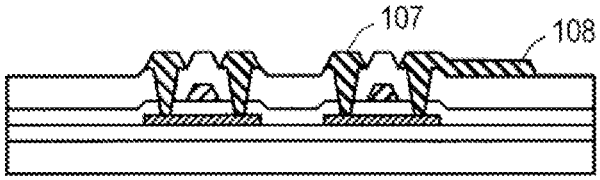

Next, as illustrated in FIG. 3D, a source electrode 107 and a drain electrode 108 are formed. The source electrode 107 and the drain electrode 108 are formed by subjecting a metal layer formed of, for example, such as Al or Mo, to patterning in a photolithography process. The thickness of the source electrode 107 and the drain electrode 108 is, for example, from 200 nm to 400 nm. In order to improve adhesiveness and improve contact resistance, a layered structure of Ti/Al, Ti/Al/Ti, Al/Ti, TiN/Al/TiN, Mo/Al, Mo/Al/Mo, Mo/AlNd/Mo, MoN/Al/MoN and the like or an alloy layer may be used.

In this manner, the TFT connected to the unit electrode 14 is produced. As needed, a TFT included in gate driver and/or a source driver may be produced at e same time.

Figure 3E:
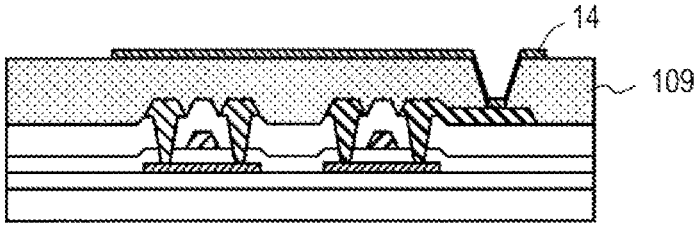

Next, as illustrated in FIG. 3E, an interlayer insulating layer 109 is formed. Through use of a photosensitive resin, the interlayer insulating layer 109 is formed in a photolithography process. The plurality of unit electrodes 14 are formed on the interlayer insulating layer 109. The unit electrode 14 is formed by forming an InZnO film having a thickness of from 50 nm to 150 nm by sputtering and subjecting the film to patterning in a photolithography process. In this case, it is preferred that the film be formed at a film formation temperature of 300° C. or lower, more preferably, 250° C. or lower such that an amorphous InZnO film is formed. Whether a desired amorphous InZnO film is formed can be determined by, for example, X-ray diffraction (XRD).

Figure 3F:
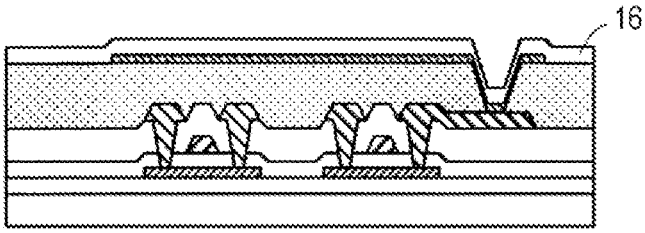

Next, as illustrated in FIG. 3F, the dielectric layer 16 is formed. The dielectric layer 16 is formed of the SiN layer.

Here, the SiN layer may be formed of a single SiN layer, but it is preferred that the SiN layer have a layered structure including two or more SiN layers with different compositions. It is preferred that the SiN layer include two or more SiN layers with different hydrogen concentrations. When the SiN layer includes a first SiN layer held in contact with the InZnO layer and a second silicon nitride layer formed on a side of the first silicon nitride layer, which is close to the hydrophobic layer 18, it is preferred that the hydrogen concentration of the second SiN layer is lower than the hydrogen concentration of the first SiN layer. The second silicon nitride layer may be held in contact with a first hydrophobic layer. It is preferred that the thickness of the first SiN layer (the $H_2$-rich SiN layer) be from 60 nm to 300 nm and that the thickness of the second SiN layer (the $H_2$-poor SiN layer) be from 40 nm to 200 nm. Further, it is preferred that the thickness of the first SiN layer (the $H_2$-rich SiN layer) be larger than the thickness of the second SiN layer (the $H_2$-poor SiN layer).

The entire thickness of the SiN layers is not particularly limited. However, it is preferred that the entire thickness of the SiN layers be from 100 nm to 500 nm, and more preferably, exceed 200 nm in view of a breakdown voltage. Further, when the entire thickness of the SiN layers is increased, a voltage to be effectively applied to a liquid droplet is reduced. Thus, it is preferred that the entire thickness of the SiN layers be 400 nm or smaller.

Control of an amount of hydrogen contained in the SiN layer may be performed by using a publicly known method that is freely selected, and may be performed with the plasma CVD by, for example, using silane, ammonia, and nitrogen as raw materials and controlling a concentration of ammonia (see, for example, JP 3045945 A).

The surface of the SiN layer may be oxidized (refer to the oxidized layer 16*b* in FIG. 2). The oxidization of the surface of the SiN layer may be achieved by, for example, annealing in an air (at a temperature of, for example, from 100° C. to 250° C.). By forming the oxidized part (part with a high oxygen concentration) 16*b* in the SiN layer, an advantageous point that adhesiveness with the hydrophobic layer 18 is improved can be obtained.

Note that, although not illustrated, an opening configured to expose a terminal portion or the like is formed by subjecting the SiN layer to patterning in a photolithography process.

Figure 3G:
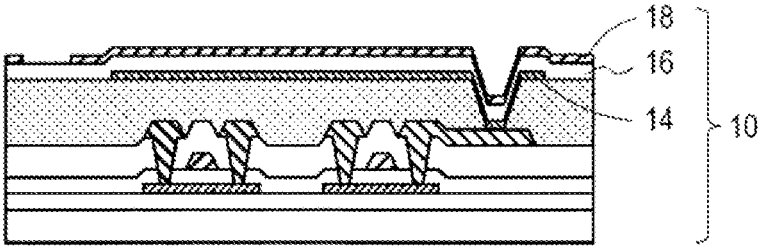

Next, as illustrated in FIG. 3G, the hydrophobic layer 18 is formed. The hydrophobic layer 18 is fluorine-based resin layer having a thickness of, for example, from 30 nm to 100 nm. As described above, the hydrophobic layer 18 is formed through use of, for example, a fluorine-based resin having a terminal functional group. Through use of a fluorine-based resin solution (including a fluorine-based resin solvent), the fluorine-based resin layer may be formed by a publicly known method. In order to improve removal of the solvent and/or stability of the fluorine-based resin, it is preferred that heat treatment of, for example, approximately from 170° C. to 200° C. be performed. Further, before the fluorine-based resin layer is formed, a silane coupling agent treatment or a fluorine-based primer treatment may be processed.

Note that, it is preferred that the hydrophobic layers 18 and 28 be prevented from being formed at portions where a sealing portion 44 (see FIG. 4D is formed and at a terminal portion (not shown). For example, after the fluorine-based resin film formed on the entire surface of the substrate, an opening may be formed at a portion being the sealing portion by, for example, a photolithography process.

In this manner, the TFT substrate 10 is obtained.

Next, FIGS. 4A to 4D are referenced. Each of FIGS. 4A to 4C is a schematic view illustrating a method of producing the counter substrate 20, and FIG. 4D is a schematic view illustrating a step of bonding the TFT substrate 10 and the counter substrate 20 to each other.

As illustrated in FIG. 4A, for example, the counter electrode 24 is formed on the glass substrate 21. The counter electrode 24 is formed on almost the entire surface of the glass substrate 21. The counter electrode 24 is formed of a transparent oxide conductive layer such as an ITO layer, an InZnO layer, and a ZnO layer. The counter electrode 24 has a thickness of, for example, from 50 nm to 150 nm, and is formed by, for example, sputtering.

Next, as illustrated in FIG. 4B, the hydrophobic layer 28 is formed. The hydrophobic layer 28 is formed by the same method as that of the hydrophobic layer 18 described with reference to FIG. 3G.

Next, as illustrated in FIG. 4C, the through-hole 20*a* configured to inject a liquid droplet is formed in the counter substrate 20. The through-hole 20*a* can be formed by a publicly known glass processing technique including machining such as drilling, laser machining, and wet etching. The diameter of the through-hole 20*a* is, for example, approximately 1 mm to 5 mm, and is selected as appropriate in accordance with an injection method and/or an injection amount.

In this manner, the counter substrate 20 is obtained.

Next, as illustrated in FIG. 4D, the TFT substrate 10 and the counter substrate 20 are bonded to each other. For example, in a region for the sealing portion 44 on the outer periphery of the TFT substrate 10, a sealing member is drawn according to a predetermined pattern through use of a dispenser. The sealing member is obtained by, for example, mixing a spacer (for example, glass beads or plastic beads with a diameter of from 200 μm to 300 μm) in a thermosetting resin.

The TFT substrate 10 and the counter substrate 20 are bonded to each other with intervened by the sealing member drawn according to the predetermined pattern on the TFT substrate 10, and the sealing member as cured by, for example, heating. In this case, the hydrophobic layer 18 and the hydrophobic layer 28 face each other, and the gap (flow path) 40 is formed therebetween. Note that, in this bonding step, a transfer (transfer electrode) configured to connect the counter electrode 24 to a terminal on the TFT substrate 10 is formed of, for example, conductive paste.

In this manner, the EWOD 100 is obtained.

Now, with test examples, it as described that the EWOD 100 according to the embodiment of the disclosure is excellent in breakdown voltage compared to an EWOD in the related art.

Test cells in Examples and Comparative Examples were produced in the following manner.

The electrodes 14 were formed through use of: an InZnO layer. The InZnO layer was formed to have a thickness of 70 nm by sputtering. In the EWOD in Comparative Examples, an ITO layer was used as the electrodes 14. The ITO layer was formed to have a thickness of 70 nm by sputtering.

An ITO layer was used the counter electrode 24 in Examples and Comparative Examples. The ITO layer was formed to have a thickness of 70 nm by sputtering.

An SiN layer was used as the dielectric layer 16 in Examples and Comparative Examples. In this case, the surface of the SiN layer was not subjected to oxidization processing. (The oxidized layer 16*b* in FIG. 2 was not formed.)

As a layered structure of the SiN layer, a $H_2$-rich SiN layer (single layer), a $H_2$-poor SiN layer (single layer), a $H_2$-rich SiN layer/$H_2$-poor SiN layer (upper layer/lower layer), and a $H_2$-poor SiN layer/$H_2$-rich SiN layer (upper layer/lower layer) were examined. Each of the SiN layers was formed by the plasma CVD, and a concentration of hydrogen atoms contained in the SiN layer (hereinafter, simply referred to as "hydrogen concentration") was adjusted by using silane, ammonia, and nitrogen as raw materials and controlling a concentration of ammonia.

The hydrogen concentration of each of the obtained SiN layers was obtained based on an absorption spectrum intensity of an Si—H bond and an N—H bond, which was obtained by the FT-IR method. The hydrogen concentration of the $H_2$-poor SiN layer obtained herein was $1.2\times10^{22}$ atoms/cm$^3$, and the hydrogen concentration of the $H_2$-rich SiN layer was $2.3\times10^{22}$ atoms/cm$^3$.

Fluorine-based resin layers were formed as the hydrophobic layers 18 and 28. Specifically, after CYTOP (trade name of Asahi Glass Co., Ltd.,) was applied by a dipping coating method, heat treatment was performed at a temperature of 170° C. for 30 minutes in order to improve removal of the solvent and/or stability of the fluorine-based resin.

During the process of producing the EWODs in Examples and Comparative Examples, the highest temperature in the thermal history to which the electrodes 14 were subjected was 170° C. Through the thermal history described above, the ITO layer was crystallized, which caused a defect in the SiN layer.

The evaluation on a breakdown voltage was performed in the following manner.

Under a state in which the gap in the EWOD (the reference symbol 40 in FIG. 2) was filled with LiCl solution of 1 mol/L, a voltage of 16 V was applied on the entire surface for 3 minutes. After that, the EWOD was disassembled, and the surface of the SiN layer was observed with an optical microscope. In this manner, the number of defects (spots at which insulation breakdowns were caused) was obtained. The insulation breakdown spots had a size of from several ten μm to several hundred μm. The observation area was approximately 100 $cm^2$, and the number of defects per unit area was obtained. In Table 1, relative values, which are expressed with the defect density (the number of defects per unit area; the number/$cm^2$) in the SiN layer (on the ITO layer) of the EWOD in Comparative Example 2 as a value of 1, are shown.

TABLE 1

| | Electrode | Dielectric layer (upper layer/lower layer) | Defect density |
|---|---|---|---|
| Example 1 | InZnO layer | $H_2$-poor SiN layer (100 nm)/$H_2$-rich SiN layer (200 nm) | 0.04 |
| Example 2 | InZnO layer | $H_2$-rich SiN layer (200 nm)/$H_2$-poor SiN layer (100 cm) | 0.07 |
| Example 3 | InZnO layer | $H_2$-poor SiN layer (300 cm) | 0.09 |
| Example 4 | InZnO layer | $H_2$-rich SiN layer (300 nm) | 0.12 |
| Comparative Example 1 | ITO layer | $H_2$-poor SiN layer (100 cm)/$H_2$-rich SiN layer (200 cm) | 0.95 |
| Comparative Example 2 | ITO layer | $H_2$-rich SiN layer (300 nm) | 1.00 |

As apparent from Table 1, in each of Examples 1 to 4, the defect density was lower than that of the Comparative Examples. Particularly, the defect density in Example 1 including the dielectric layer having the same configuration as that in Comparative Example 1 has a remarkably small value, which is four hundredths of the defect density in Comparative Example. That is, the defect density can be lowered by replacing the ITO layer with the InZnO layer in the electrodes.

Based on the comparison between Example 3 and Example 4, it is understood that the $H_2$-poor SiN layer has an effect of lowering the defect density more remarkably than the $H_2$-rich SiN layer.

Based on the comparison between Examples 1 and 2, and Example 3, it is understood that an effect of lowering the defect density is exerted more in the case of the layered structure. However, based on the comparison between Comparison Example 1 and Comparison Example 2, it is understood that an effect of lowering the defect density is scarcely exerted by the layered structure in the case where the electrodes are formed of the ITO layer.

Based on the comparison between Example 1 and Example 2, it is understood that an effect of lowering the defect density is exerted more in the case where the $H_2$-poor SiN layer is an upper layer (held in contact with the hydrophobic layer) and the $H_2$-rich SiN layer is lower layer (held in contact with the InZnO layer).

Note that, as described above with reference to FIG. 2, since the oxidized layer 16*b* is formed by oxidizing the surface of the upper $H_2$-poor SiN layer, adhesiveness with the hydrophobic layer 18 can be improved.

As described above, by forming the SiN layer directly on the InZnO layer, a defect density can be lowered. Therefore, the electrowetting device, which includes the SiN layer excellent in breakdown voltage compared to the related art and can be driven at a low voltage, is obtained.

The embodiments of the disclosure is widely applicable to an electrowetting device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

The invention claimed is:

1. An electrowetting device, comprising:

a first substrate;

a plurality of first electrodes formed on the first substrate;

a dielectric layer formed on the plurality of first electrodes;

a first hydrophobic layer formed on the dielectric layer;

a second substrate;

a second electrode formed on the second substrate; and a second hydrophobic layer formed on the second electrode, wherein the first substrate and the second substrate are arranged with a gap between the first hydrophobic layer and the second hydrophobic layer, each of the plurality of first electrodes includes an indium oxide-zinc oxide layer, the dielectric layer includes a first silicon nitride layer held in contact with each of the plurality of first electrodes and a second silicon nitride layer formed on a side of the first silicon nitride layer, the side close to the first hydrophobic layer, the second silicon nitride layer has a hydrogen concentration lower than a hydrogen concentration of the first silicon nitride layer, the first silicon nitride layer is formed directly on the indium oxide-zinc oxide layer, and the second silicon nitride layer is held in contact with the first hydrophobic layer.

2. The electrowetting device according to claim 1, wherein the second silicon nitride layer is thinner than the first silicon nitride layer.

3. The electrowetting device according to claim 1, wherein the indium oxide-zinc oxide layer is amorphous.

4. An electrowetting device, comprising:

a first substrate;

a plurality of first electrodes formed on the first substrate;

a dielectric layer formed on the plurality of first electrodes;

a first hydrophobic layer formed on the dielectric layer;

a second substrate;

a second electrode formed on the second substrate; and a second hydrophobic layer formed on the second electrode, wherein the first substrate and the second substrate are arranged with a gap between the first hydrophobic layer and the second hydrophobic layer, each of the plurality of first electrodes includes an indium oxide-zinc oxide layer, the dielectric layer includes a first silicon nitride layer held in contact with each of the plurality of first electrodes, a second silicon nitride layer formed on the first silicon nitride layer, and an oxidized layer formed between the second silicon nitride layer and the first hydrophobic layer, the second silicon nitride layer has a hydrogen concentration lower than a hydrogen concentration of the first silicon nitride layer, the first silicon nitride layer is formed directly on the indium oxide-zinc oxide layer, and the oxidized layer is held in contact with the first hydrophobic layer.

* * * * *